US007981014B2

(12) United States Patent
Ross et al.

(10) Patent No.: US 7,981,014 B2
(45) Date of Patent: Jul. 19, 2011

(54) RESISTANCE SYSTEM FOR FITNESS EQUIPMENT

(75) Inventors: Glenn D. Ross, Marietta, GA (US); Brad R. Olschansky, Roswell, GA (US); Scott M. Olschansky, Roswell, GA (US); Kevin G. Abelbeck, Fort Collins, CO (US)

(73) Assignee: Exersmart, LLC, Marietta, GA (US)

( * ) Notice: Subject to any disclaimer, the term of this patent is extended or adjusted under 35 U.S.C. 154(b) by 0 days.

(21) Appl. No.: 12/146,068

(22) Filed: Jun. 25, 2008

(65) Prior Publication Data

US 2008/0318740 A1 Dec. 25, 2008

Related U.S. Application Data

(60) Provisional application No. 60/929,358, filed on Jun. 25, 2007.

(51) Int. Cl.
*A63B 21/04* (2006.01)

(52) U.S. Cl. ..... 482/129; 482/130

(58) Field of Classification Search ..... 482/94–96, 482/101–103, 121, 129–133
See application file for complete search history.

(56) References Cited

U.S. PATENT DOCUMENTS

| | | | | |
|---|---|---|---|---|
| 4,666,149 | A * | 5/1987 | Olschansky et al. | 482/130 |
| 5,039,092 | A * | 8/1991 | Olschansky et al. | 482/130 |
| 5,074,551 | A | 12/1991 | Olschansky et al. | |
| 5,522,784 | A * | 6/1996 | Grant | 482/130 |
| 5,700,232 | A * | 12/1997 | Clausen et al. | 482/125 |
| 6,045,491 | A * | 4/2000 | McNergney et al. | 482/121 |
| 7,597,653 | B1 * | 10/2009 | Lindemeier | 482/129 |
| 2006/0105889 | A1 * | 5/2006 | Webb | 482/94 |
| 2006/0205571 | A1 * | 9/2006 | Krull | 482/94 |
| 2007/0203001 | A1 * | 8/2007 | Krull | 482/94 |

* cited by examiner

*Primary Examiner* — Fenn C Mathew
(74) *Attorney, Agent, or Firm* — Rosenberg, Klein & Lee

(57) ABSTRACT

A resistance system for an exercise device includes a frame, a resistance element such as elastic bands, coil springs, weight plates, pneumatic or hydraulic cylinders. An interference element such as a plate, chain or one or more links is supported by a support plate mounted on the frame. Selective engagement with the resistance element is provided by actuation of a dial, other actuator or controller or directly by the user. Thereby the resistance element can be selectively engaged or disengaged to vary the resistance to the user.

47 Claims, 15 Drawing Sheets

RESISTANCE SYSTEM FOR FITNESS EQUIPMENT

CROSS-REFERENCE TO RELATED APPLICATION DATA

Priority is claimed under 35 U.S.C. §119(e) to Provisional Application No. 60/929,358 filed on Jun. 25, 2007, which is incorporated by reference herein.

The present application incorporates by reference as if fully described herein U.S. Pat. No. 5,074,551.

FIELD OF THE INVENTION

The present invention generally relates to fitness equipment and, more particularly, to a system for altering the resistance in an exercise device.

BACKGROUND OF THE INVENTION

Exercise is becoming more and more of a way of enabling a healthy lifestyle. Resistance or "strength" equipment has repeatedly been shown to provide numerous benefits including increased bone density, increased lean tissue mass and also some cardiovascular benefits. In addition cardiovascular equipment has a wide range of health and fitness benefits. A component to strength equipment is the ability to change the resistance. Not only are some people stronger than others and some muscle groups stronger than others with the same person, but as a user progresses in a strength program preferably the machine provides greater resistance. Therefore the ability to change resistance with any exercise device, especially a resistance or strength machine enhances the usefulness of the device. It is desirable to have ease of use, and high variability in the resistance selection system. This allows minimal down time during training as well as small increments in resistance over a great range to accommodate the largest audience as possible.

It should therefore be appreciated that there is a need for an adjustable resistance setting device that allows for actuation of a dial, other actuator or direct actuation of a resistance system to simply, easily and reliably change the resistance settings in an exercise device. The present invention fulfills this need and others.

SUMMARY OF THE INVENTION

The present invention provides a frame which may include a support plate, a carriage moveably mounted to the frame and plural resistance elements each including a support flange on a first end and a second end coupled to the carriage. An interference element is adapted to enable selective simultaneous engagement with the support flange of more than one resistance elements so that movement of the carriage encounters different resistance to that movement depending upon the resistance elements engaged. The interference element may be supported by the support plate. The resistance element may be a plurality of individual elements of the same or different load producing capabilities. The resistance elements may include elastic cords, weights, pneumatic cylinders or hydraulic cylinders.

An alternative embodiment of the invention includes the elements as previously disclosed, the differences being the interference element is coupled to the carriage and the second end of the resistance elements are coupled to the frame. In this manner, as with the previous embodiment, as the carriage is displaced the resistance elements which are supported by the interference element will generate a load to the user and the resistance elements that do not have their support flanges engaged by the interference element will not generate a load to the user.

The invention may also include an actuation system including a dial or lip adapted to be grasped by a user. The actuation system being coupled to the interference element to enable displacement of the interference element relative to the support flange and therefore the resistance element.

The invention may also include a positioning system coupled to the interference element to enable incremental positioning of the interference element relative to the resistance element. This may include a sprocket mounted to a dial and a spring biased pin engaging with detents in the sprocket. In addition, the positioning system may include a spring pin coupled to the interference element and releasably engaged with a rail secured to the frame.

The support flange of the invention may take on a number of different forms such as an undercut, tab or cap, all similar in function. The support flange may include an undercut adapted to receive the interference element. In some cases the undercut will be open on two sides so as to allow through passage of the interference element.

In a similar manner, the interference element may vary in form though providing the same or similar function. The interference element may be comprised of one or more links mounted to a pliable belt, a plurality of links moveably coupled one to another to form a continuous link, a plurality of links joined together and made into a continuous link by the free ends being joined by a pliable belt or a plurality of links joined to a pliable belt. The interference system may also include a substantially flat plate with at least one slot adapted to receive the support flange. In many cases more than one slot is used and the slots may be notched, thus providing more than one width of an area of the slot. The flat plate may also be semi-pliable and therefore flexible such as could be the case if manufactured from spring steel. Also the interference element may be comprised of a chain with at least one chain ear extending laterally from one side of a chain link, the chain ear adapted to be received by the support flange.

In addition a method of use of the resistance system is disclosed in which the elements of the device are provided, a user positions the interference element relative to the resistance element(s) and moves the carriage. This provides a selected tension for the user to exercise the body.

For the purposes of summarizing the invention and the advantages achieved over the prior art, certain advantages of the invention have been described herein. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiments disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
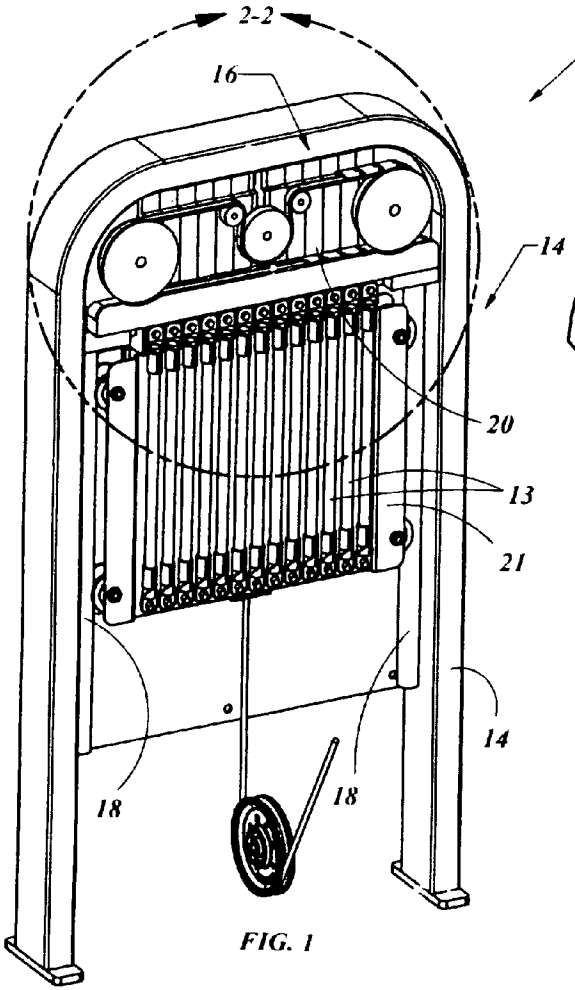
FIG. 1 is an isometric rear view of a base of a resistance system for an exercise machine incorporating a resistance system in accordance with the present invention.

With reference to the illustrative drawings, and particularly to FIG. 1, there is shown a device 12 incorporating a resistance system as it could be used for an exercise machine. This device 12 has been adapted for resistance by spring resistance cords 13. Throughout this disclosure, resistance is illustrated in this form as resistance cords 13, but it is understood that any form of resistance may be used with the invention including springs of many types, such as coil springs and elastic cords, weight plates; hydraulic and pneumatic cylinders and fluid systems with controlled flows such as hydraulic dampers or shocks. In addition, the resistance cords 13 are shown as elastic cords such as bungee cords, but could also be coil springs, fiberglass, carbon fiber or any other suitable material and configuration which allows for the storage of mechanical energy by stretching, bending, twisting or other physical deformation.

The system 12 of FIG. 1 has a frame 14 that supports an indexing mechanism 16. Two rails 18 are shown, one on each side of the frame 14. A plurality of resistance cords 13 is provided that are individually mounted to each of the slide blocks 20. The resistance cords 13 are mounted at the lower end to a carriage 21 that is guided by the rails 18. By locking any one or combination of individual slide blocks 20 to the frame 14, when the carriage 21 is moved down, away from the supported slide blocks 20, spring tension is generated in opposition to movement of the carriage as may be caused by a user. By securing more or fewer slide blocks 20, and thereby cords 13 the resistance to the user can be varied. An effective resistance training machine varies the resistance to accommodate users of different physical abilities and different muscle groups of the same user vary in strength potential. Also, preferably, as a user progresses and becomes stronger as an adaptation to resistance training exercise, the resistance applied continues to increase to meet the user's increased potential.

Figure 2:
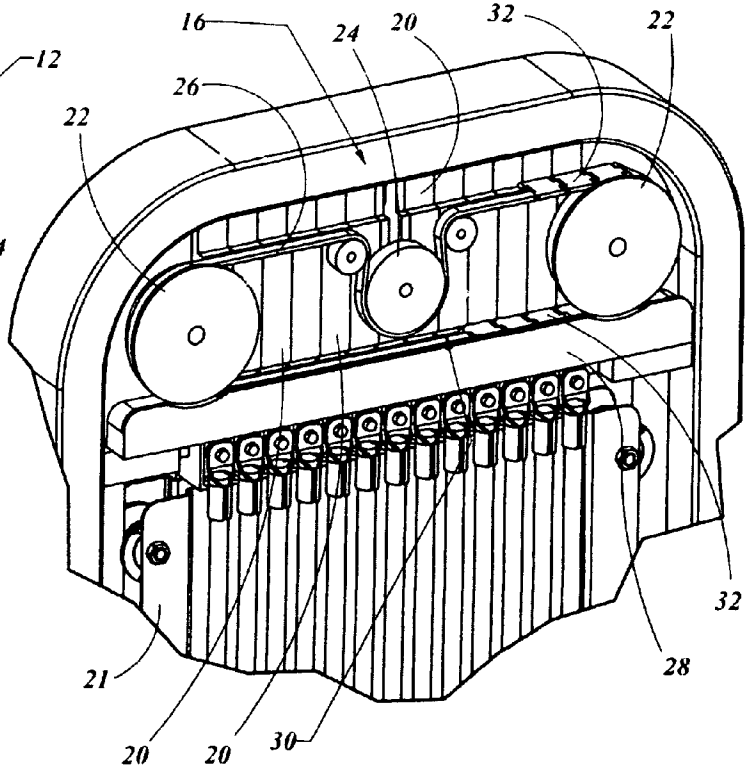
FIG. 2 is a detail of the top section of the base of a resistance system for an exercise device of FIG. 1 cut along line 2-2 of FIG. 1.

With reference to FIG. 2, a more detailed view of the indexing mechanism 16 is shown. In this embodiment of the invention, a pair of guide wheels 22 is positioned on either side of, and adjacent to the drive wheel 24. The drive wheel 24 is actuated by a knob (not shown) on the front side of the device 12. The drive wheel 24 mechanically drives a belt 26 in a serpentine manner near the upper portion of the slide blocks 20. Near the lower edge of the guide wheels 22 is a support plate 28 being rigidly mounted to the frame 14 of the device 12. The support plate 28 is substantially flush with the lower edge of an undercut 30 (also shown in FIG. 7) in each of the slide blocks 20. The belt 26 is positioned adjacent to the undercut 30 with the bottom run of the belt 26 supported at least in part on the support plate 28. A portion of the continuous loop of the belt 26 includes links 32 that extend beyond the width of the belt 26 extending in the direction of the slide blocks 20. Links 32 may be strategically positioned on the belt 26, or the links 32 may form a portion of the loop such that the belt 26 and the links 32 are joined in series to complete the closed loop. When positioned on the lower run, the edges of the links 32 can be moved to be received by the undercut 30 in some or all of the slide blocks 20. The links 32 that are received by the undercut 30 of any of the slide blocks 20 have the outer portion of the links 32 supported on the support plate 28, the links providing a bridge to the support plate 28. Those slide blocks 20 are therefore supported by the support plate 28, which is mounted to the frame. This support system inhibits at least partially the downward movement of those individual slide blocks 20 when the carriage 21 is actuated down by the user. This support offers a reaction force so that tension is generated in the resistance cord 13 associated with that particular slide block 20. By actuating the drive wheel 24 and causing the lower run of the links 32 to advance to the left in the view shown in FIG. 2, more slide blocks 20 and therefore more resistance cords 13 are engaged and the tension to the user is increased. By reversing the movement to the right, fewer slide blocks 20 are engaged and therefore the resistance to the user is reduced.

Figure 4:
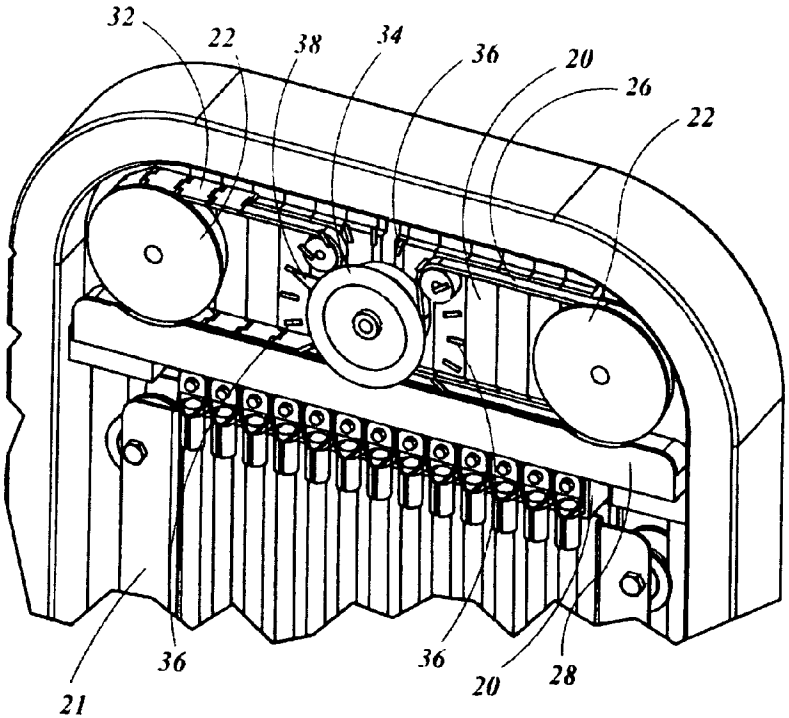
FIG. 4 is a detail of the top section of the device shown in FIG. 3 cut along line 4-4 of FIG. 3.
Figure 3:
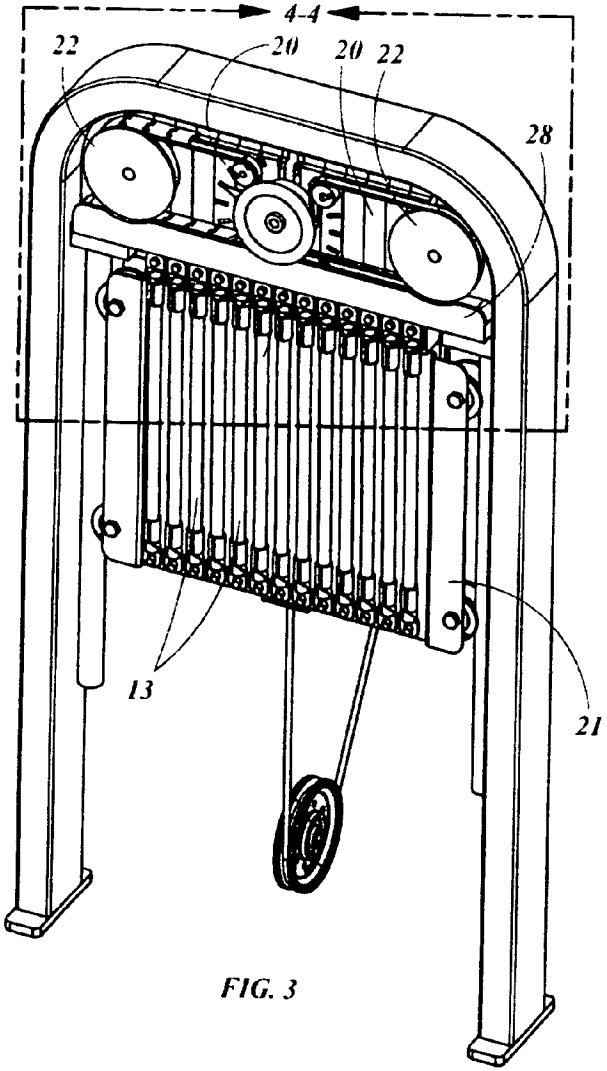
FIG. 3 is an isometric front view of a base of the device of FIG. 1 shown with the front cover removed.

With reference to FIGS. 3 and 4, a front view of the apparatus is shown, with more detail in FIG. 4. In both views the front cover has been removed to better show the detail of these aspects of the invention. The front of the machine allows access to the user. The dial 34 is easily accessible by the user. A position indicator is shown in one embodiment as a series of indication marks 36 that correspond to the position indicator 38, which is mechanically linked to the dial 34. The indication marks 36 are one means of identification of the resistance provided by the device 12 as will be described in more detail below. In many embodiments these indication marks have been removed to better show other aspects of the invention. The position indicator 38 gives visual feedback to the user as to the resistance set by the mechanism 16. The dial 34 is in mechanical communication with the drive wheel 24 (FIG. 2) which drives the belt 26 and attached links 32. As such, a specific position of the dial 34 corresponds to a direct orientation of the links 32 relative to the slide blocks 20, and therefore the number of slide blocks 20 which are engaged or free to move relative to the frame 14, providing a specific resistance to the user.

Figure 5:
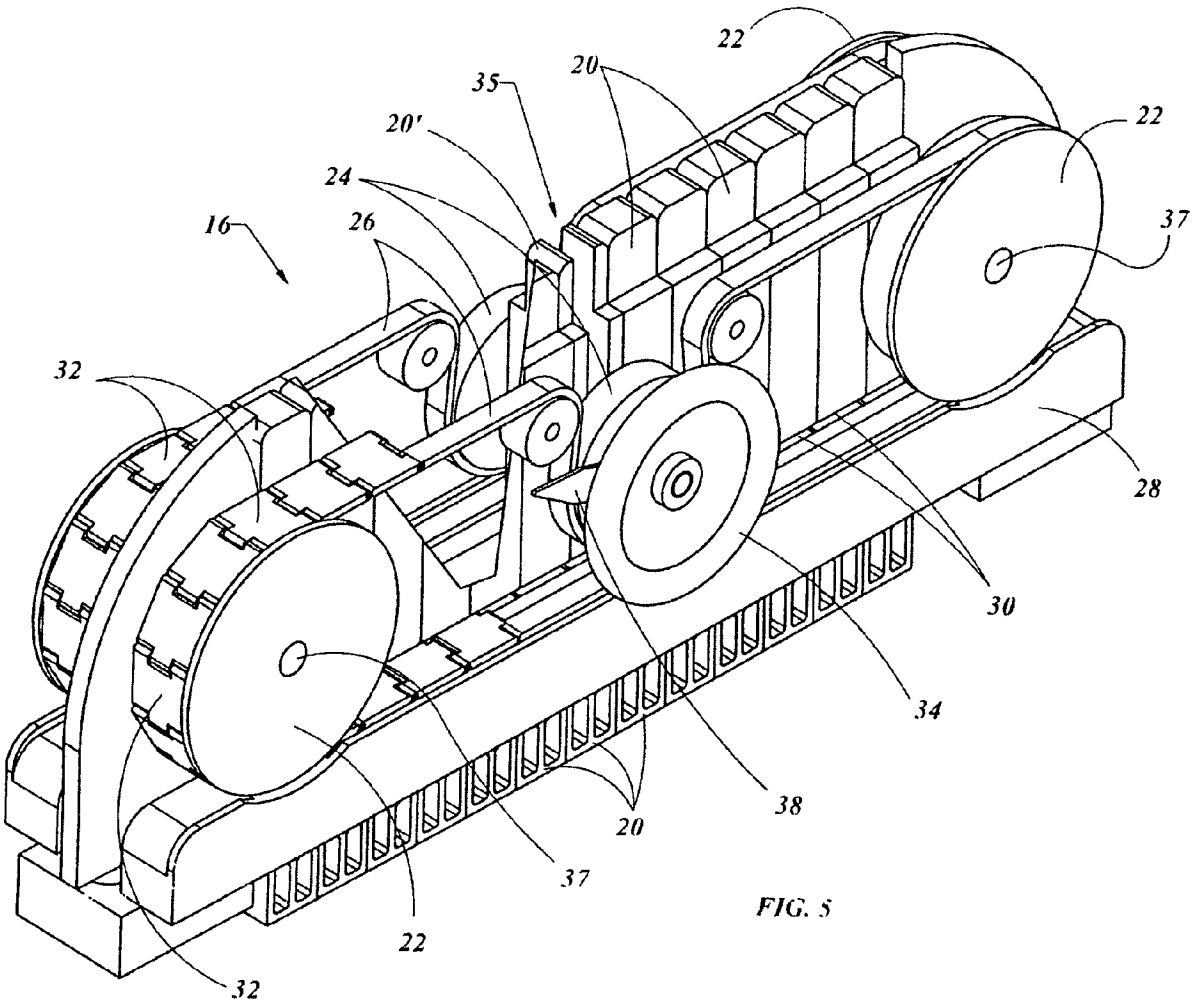
FIG. 5 is a partial isometric view of an interference mechanism removed from the device of FIG. 1 shown with a break out of the center portion of the slide blocks.

With reference to FIG. 5, a detail of the indexing mechanism 16 is shown alone from the rest of the device 12. The center section of the slide blocks 20 are broken out to better give a full view of the mechanism. The dial 34 articulates with and drives the belts 26. A portion of the belt 26 includes a series of links 32. These links 32 with the belt 26 complete a loop around the drive wheels 24. In this embodiment there are two belt 26 and link 32 systems, one on each side of the slide blocks 20. The links 32 are received by the undercut 30 in the slide blocks 20 only when the links 32 are supported on the support plate 28. By supporting the slide blocks 20 on the front and rear there is no eccentric load in the blocks 20 when they are loaded. It has been determined by the applicants that support on a single side of the slide blocks 20 is functional and will be discussed relative to another embodiment.

In this view, the center slide block 20' is shown with a center slot 35. This is one of many solutions to a potential interference issue of an axle 40 (shown in FIGS. 7-10) that may be used to connect the drive wheels 24 to the dial 34. In other embodiments, a shortened center slide block 20' may be used or a space may be provided between the two slide blocks 20 positioned closest to the dial 34, thus allowing the axle 40 to pass from the front to the rear of the mechanism 16 without interference with the slide blocks 20. Still another method of synchronizing the front and rear belts 26 may be done without the axle 40. In this embodiment, the adjacent guide wheels 22 on one or both ends of the mechanism 16 may be joined to their adjacent guide wheel 22 on the side of the mechanism 16 by a shaft 37. The common movement of the adjacent guide wheels 22 causes the belts 26 to move together, thereby linking the movement of the belts 26 to one another. In this view a dial 34 is shown as the method of user interaction with the method of positioning the links 32. It is understood that alternate forms can also be used in this or any other embodiment of the invention including an electric motor adapted to actuate the system remotely or by a switch mounted on the device 12. In this embodiment the dial 34 would not be necessary.

Figure 6:
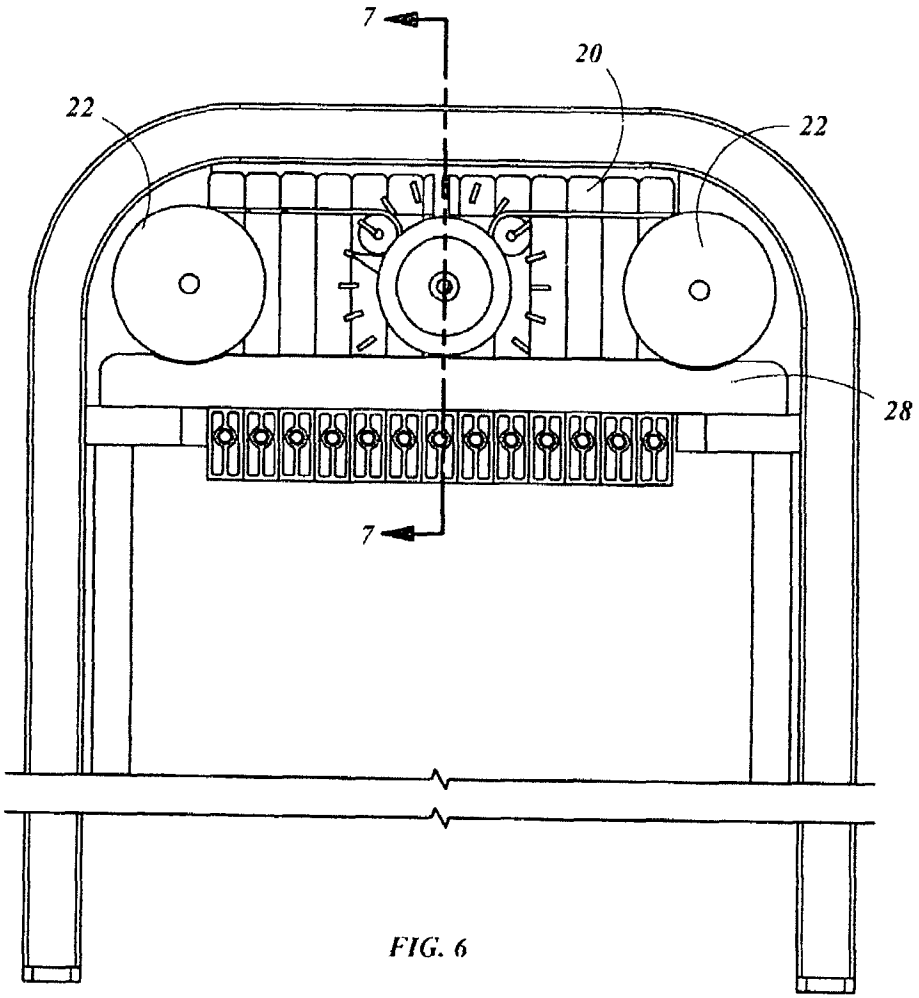
FIG. 6 is a front broken view of the device of FIG. 3 shown with the front cover, carriage and resistance cords removed.
Figure 7:
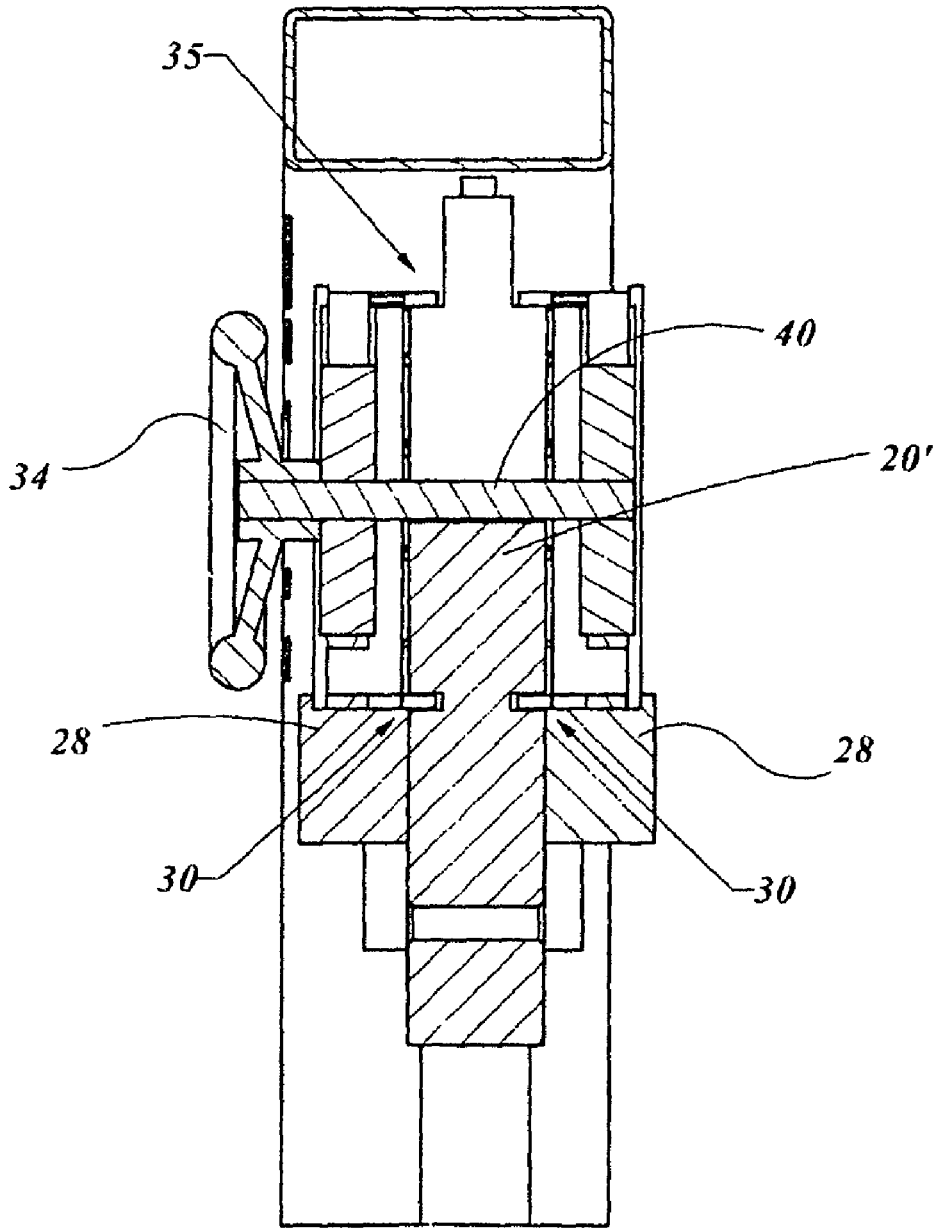
FIG. 7 is a section view of the interference resistance system of the machine, shown along the section line 7-7 of FIG. 6.

More detail of the engagement of the links 32 to the slide blocks 20 and 20' is shown in FIG. 6 and the section view in FIG. 7. The undercut 30 is clearly seen in FIG. 7 in this embodiment and is provided on both sides of the slide block 20 and 20' as previously stated. This provides a more balanced distribution of load to the system by pulling on both sides concurrently as well as doubling the area of distribution of load shear so as to reduce the stress in the slide blocks 20 and 20' and the links 32 as compared to using one side only when a force is applied to pull the slide block 20 and 20' down. It is understood that this is not critical to the novelty of the invention and in some cases, as will be shown if further embodiments of the invention, a system with support on a single side will be used.

Figure 8:
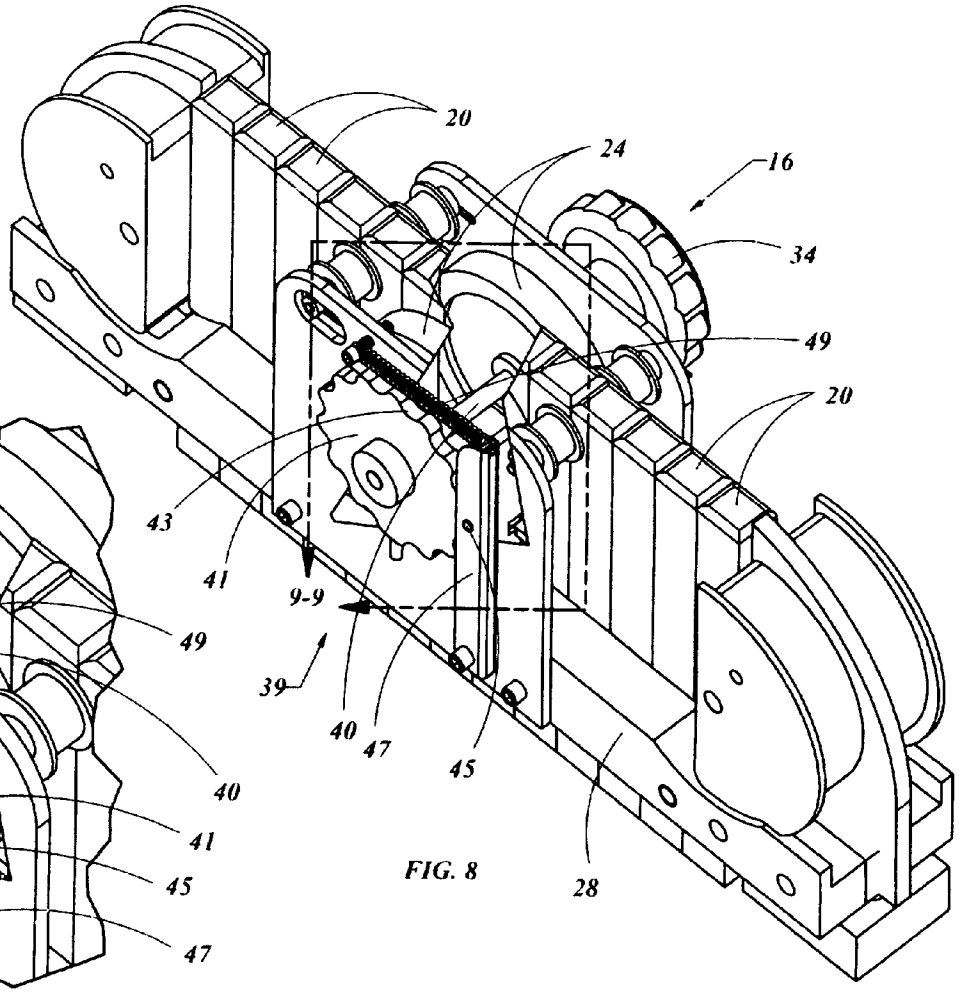
FIG. 8 is an upper isometric view with the center slide blocks and structure broken out to show the positioning system with the resistance elements removed.
Figure 9:
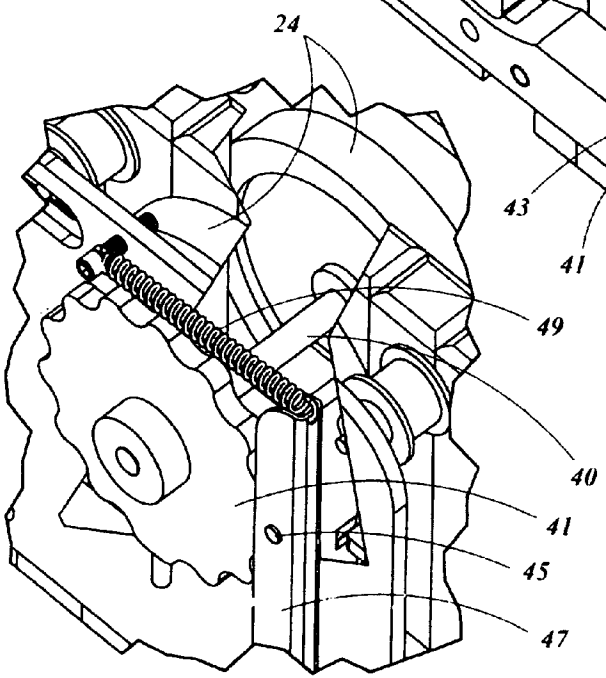
FIG. 9 is a detail view of the incremental portion of the positioning mechanism of FIG. 8 cut along line 9-9 in FIG. 8.

The positioning mechanism 39 is shown in FIG. 8 with the center structure of the indexing mechanism 16 and the center slide blocks 20 broken out for clarity of the illustration. Also referring to this description is the detail view of FIG. 9 shown along the line 9-9 in FIG. 8. The belt 26 and links 32 have also been removed in these views. This illustrates one method of locating the links 32 in the proper position relative to each slide block 20. Proper positioning of a link 32 so that it is fully engaged in the undercut 30 of a slide block 20 that is to be supported is helpful. If a link 32 is positioned only half way in the undercut 30 of a slide block 20, the pressure on that slide block 20 at the undercut 30 will be twice as great as if the link 32 was fully engaged.

This potential for excessive forces on the slide blocks 20 was solved by providing a positioning mechanism 39 that is mounted to the knob 34 by way of the knob axle 40. The axle 40 is securely mounted to the drive wheels 24 which drive the belt(s) 26 and therefore the links 32. A sprocket 41 is also secured to the axle 40. This sprocket 41 has a series of detents 43 along the peripheral edge. These detents 43 mate with the pin 45 secured to the lever arm 47, which is pivotally mounted to the frame of the indexing mechanism 16. The angular displacement or the sprocket 41, and therefore the axle 40, from one detent 43 to the adjacent detent 43 is equal to the linear displacement of the belt 26, which is the distance of the spacing of one slide block 20 to the adjacent slide block 20. A spring 49 acts as a bias to pull the lever arm 47 and pin 45 toward the sprocket 41. The combination provides that as the knob 34 is turned by a user, it will move one "click" at a time in either direction to add or remove the links 32 one full slide block 20 at a time eliminating the potential for a link 32 to be only partially engaged with the undercut 30 of any slide block 20.

Figure 11:
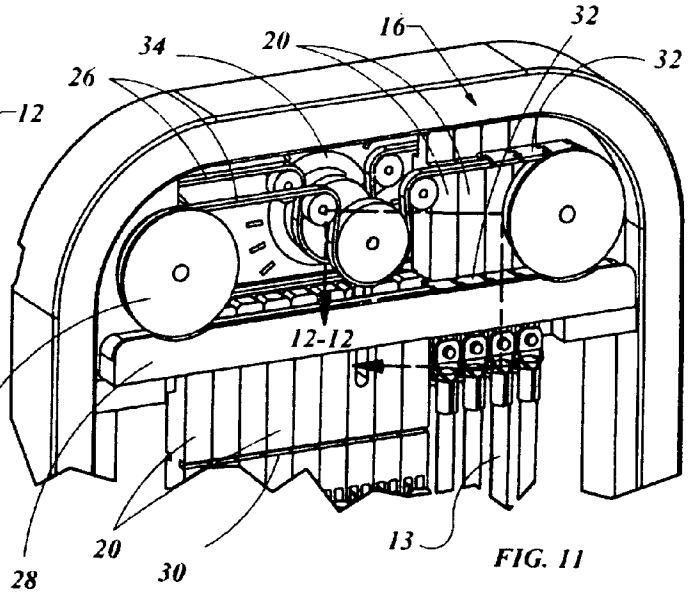
FIG. 11 is a detail view of the upper portion of the resistance system shown in FIG. 10 cut along line 11-11 of FIG. 10.
Figure 12:
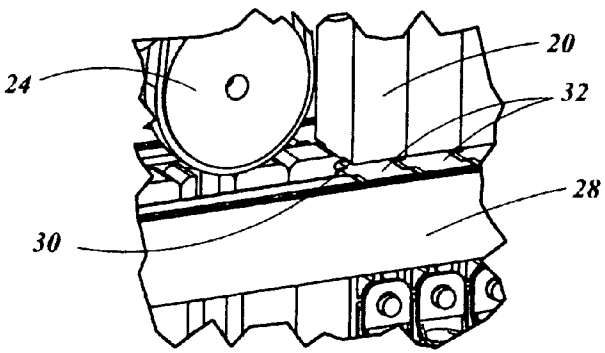
FIG. 12 is a detail view of the slide block engaging with the links of the resistance system as shown in FIG. 10 cut along line 12-12 of FIG. 11.
Figure 10:
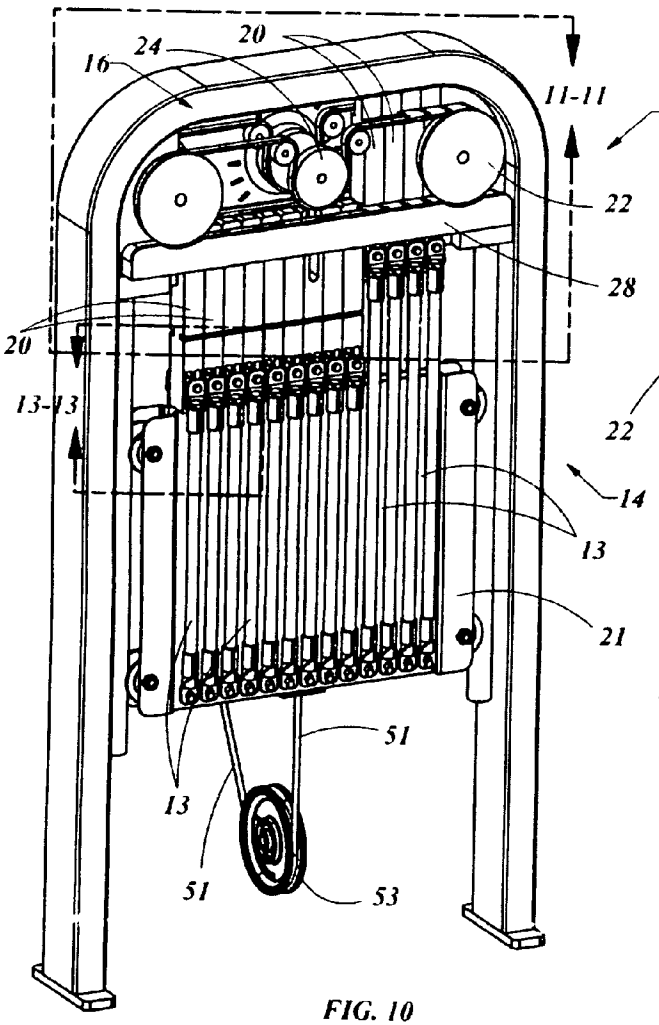
FIG. 10 is an isometric view of the resistance system of FIG. 1 with the carriage extended as it would be in use with a portion of the resistance cords engaged.

The indexing mechanism 16 of the device 12 is shown in use in one embodiment in FIGS. 10-12. FIG. 10 shows a carriage 21 with a plurality of resistance cords 13 mounted to the lower portion of the carriage 21. A cable 51 supported by a pulley 53 (which would be rotatably mounted to the frame 14) and the free end of the cable 51 would be adapted for direct or indirect communication with the user to actuate the cable 51 to exercise the muscles of the user. The upper portion of the cords 13 are each mounted to a slide block 20. In this view as well as FIGS. 11 and 12, it is shown that the four slide blocks 20 on the right are supported by the support plate 28, which is secured to the frame 14, by way of the links 32 being positioned on top of the support plate 28 and received by the undercut 30 of those four slide blocks 20. The rest of the slide blocks 20 not having links 32 in their respective undercut 30 are free to move down with the carriage 21 as the carriage 21 is actuated. The four cords 13 on the right are then stretched and thus provide a resistance to movement of the carriage 21 provided by tension in the cable 51.

Figure 13:
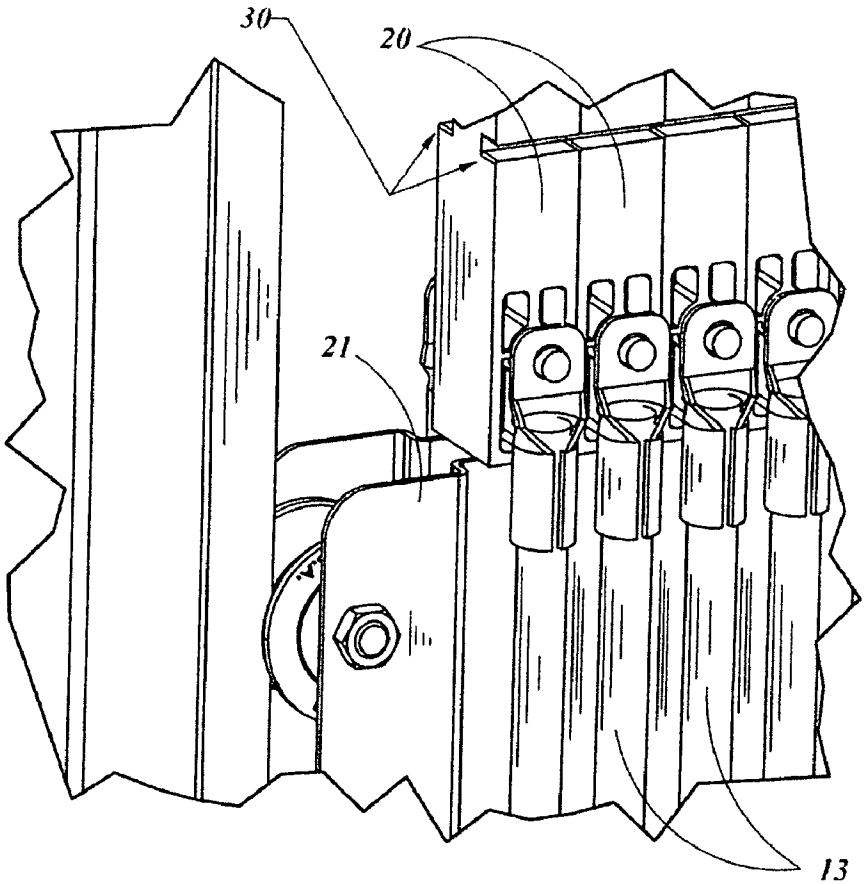
FIG. 13 is detail view of the slide block as it is supported by the carriage in FIG. 10 along line 13-13 of FIG. 10.

The slide blocks 20 that are not supported by a link 32 and are therefore free to move with the carriage 21 are supported on the carriage 21. One method of support is shown in FIG. 13. The bottom portion of the slide blocks 20 rest on the top of the carriage 21 and therefore when not engaged by a link 32, move up and down with the carriage 21. This is only one method of supporting the slide blocks 20. Related forms are shown in the prior art of reference. Various forms of support of the slide blocks 20 on the carriage 21 could be incorporated here. As the user allows the carriage 21 to move back up due to the tension of the engaged cords 13, the slide blocks 20 supported by the carriage 21 will move back up to be positioned adjacent to the slide blocks 20 that are supported by the links 32. In this and other views, some of the structure of the frame 14 has been removed to better show specific features of the invention. Here, one or more physical guides can be used to insure the slide blocks 20 move in a controlled and reasonably precise path.

It may be desirable to have the cords 13 slightly tensioned when in this semi-relaxed state (slide blocks 20 moving with the carriage 21). This may serve several purposes. First, the slide blocks 20 are firmly held to the top (in this vertical movement orientation of the carriage 21) of the carriage 21 when the slide blocks 20 are not engaged by the link 32 and providing resistance to movement of the carriage 21. The second advantage is the cords 13 may offer a "preload" to allow the user immediate resistance when actuated. This helps eliminate the "lag" or "mushy" feeling at the beginning of the movement which is found with some devices. In some cases a cord 13 may also be permanently engaged with the carriage 21 to offer a bias in the direction of the links 32. This is one way to move the carriage 21 to the starting position to enable engagement with the links 32.

When the device 12 is relaxed, the carriage 21 will move back up to the starting position with all slide blocks 20 fully elevated. At that point the user can actuate the knob 34 and drive the links 32 to support more slide blocks 20 and increase the resistance to movement by way of the cable 51 or actuate the knob 34 in the opposite direction to remove the links 32 from the undercut 30 of one or more slide blocks 20, thereby reducing the resistance to movement of the carriage 21 by way of the cable 51.

An alternative embodiment is shown in FIGS. 14-17. This embodiment shows a system with many of the same components including a dial 34 and guide rails 18. In this embodiment the resistance is also a plurality of resistance cords 13. Again, the system could be adapted to apply to any number of types of resistance. One advantage to resistance cords 13 is the mass is negligible relative to the tension produced and therefore the physical orientation of the system is substantially irrelevant. In the embodiment as shown in FIGS. 14-17 the resistance cords 13 are mounted horizontally. The carriage 21 is moved in the direction of the arrow 44 when tension is produced by the user. Any number of mechanisms can be used for the purpose, most probably as previously disclosed a pliable cable, cord or belt with a distal end adapted to interaction with the user is preferred. The carriage 21 moves linearly on the guide rails 18 by a slide, linear bearing or roller mechanism. This is not shown in this embodiment but it would be similar to that as previously disclosed. This also pertains to the support plate 28, not shown in FIGS. 14-17 and 20-22. These figures illustrate different elements and most of the parts of the frame have been removed to better show these features. Preferably, the support plate 28 or its functional equivalent is present on the carriage 21 side of an index plate 46 or link 32 in all the embodiments of the invention. As is illustrated in this and other figures the index plate 46 has functionally equivalent features to the link 32 of the previously described embodiments of the invention.

The reaction force to enable resistance in the resistance cords 13 is provided by the index plate 46 and as noted a support plate 28 (not shown) secured to or as part of the frame 14. As in the previous embodiment, the carriage 21 is displaced by the user, the variation in tension is determined by the number of resistance cords 13 in which the free end is secured to the frame to offer a resistive force. In this embodiment, the dial 34 drives a flexible member 48 such as a cable, belt or chain. The flexible member 48 is attached to each end of the index plate 46 as shown. Turning the dial 34 to the right moves the index plate 46 down, increasing the number of resistance cords 13 supported by the index plate 46 and turning to the left moves the index plate 46 up, reducing the number of cords 13 supported by the index plate 46.

Figure 15:
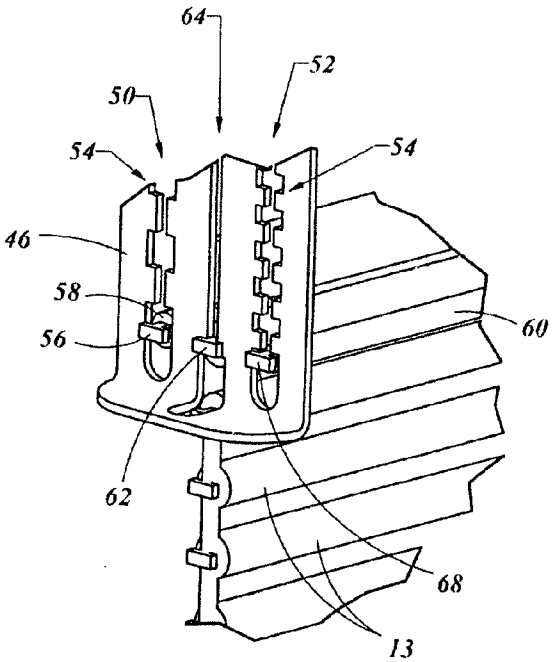
FIG. 15 is a detailed view of the plate and resistance cords of the device of FIG. 14 cut along line 15-15 of FIG. 14.
Figure 14:
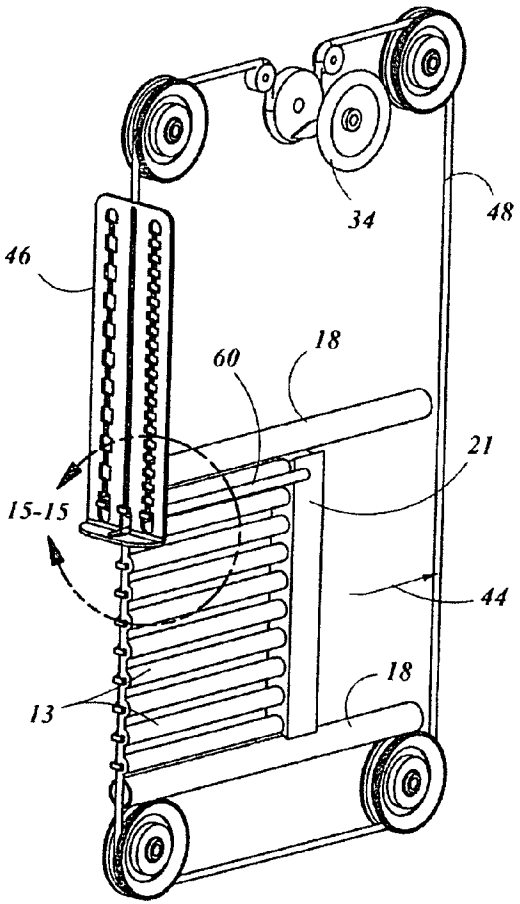
FIG. 14 is an isometric view of an alternative resistance system with a horizontal resistance cord system shown removed from an exercise device.

In FIG. 15, a detail of the index plate 46 and the relationship to the resistance cords 13 is shown. In this embodiment a finer resistance adjustment can be made in that the index plate 46 includes three slots. The left slot 50 and right slot 52 have a series of spaced openings 54. When the index plate 46 is positioned such that the corresponding left resistance cord tab 56 passes through the opening 54, that particular resistance cord does not generate any tension to the user. The left resistance cord 58 and right resistance cord 60 may be of lesser tension capability (lower spring constant) than the main center resistance cords 13. For example, the left resistance cord 58 offers ten pounds of resistance to the user and the right resistance cord 60 may be designed to provide five pounds of resistance to the user and the main center resistance cords 13 may be designed to offer twenty pounds of resistance. In the position shown only the center tab 62 is supported by the edges of the center slot 64, so the total resistance would be twenty pounds to the user.

Figure 17:
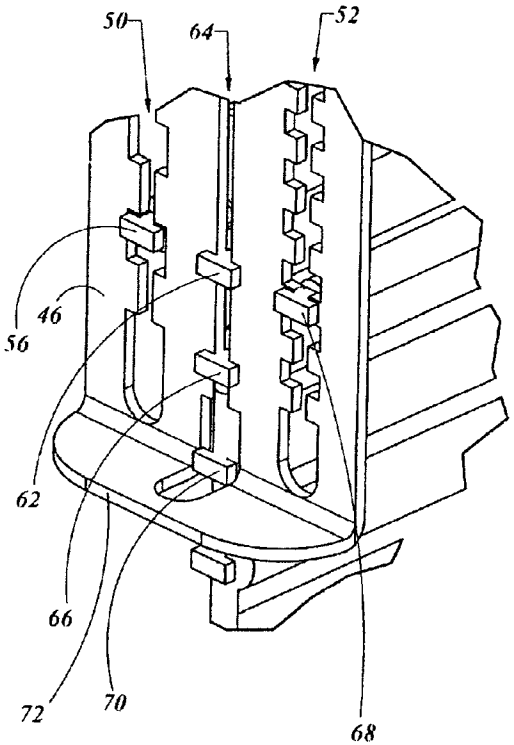
FIG. 17 is a detailed view of the plate of FIG. 16 cut along line 17-17 of FIG. 16.
Figure 16:
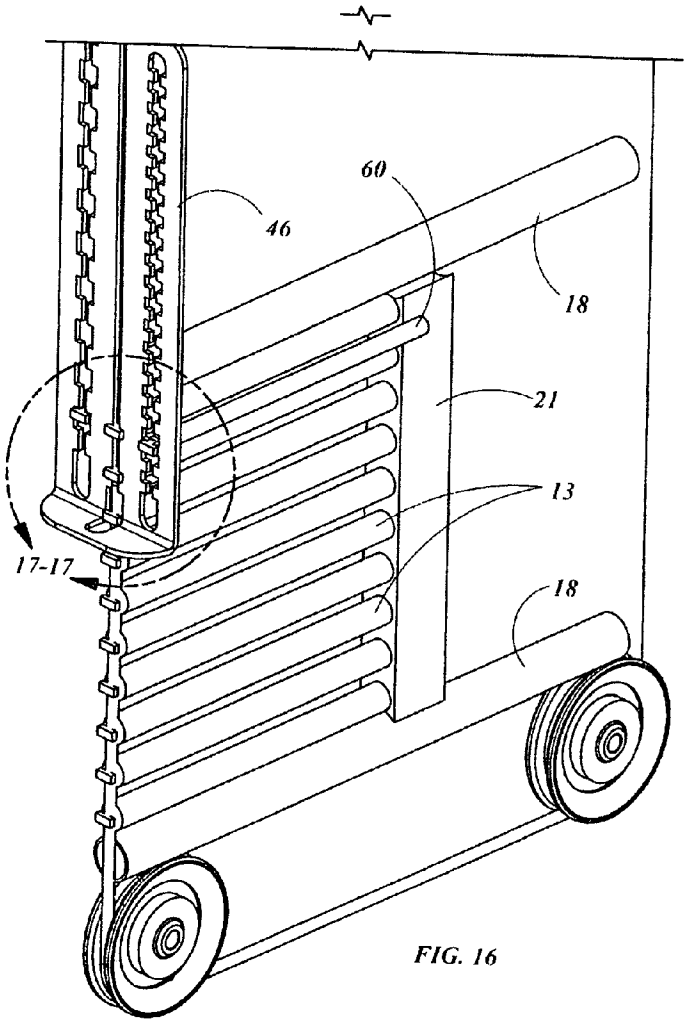
FIG. 16 is an isometric partial view of the lower portion of the device of FIG. 14 with the index plate moved to an increased resistance relative to that shown in FIG. 14.

In FIGS. 16 and 17 the index plate 46 has been actuated (moved down) to a higher tension. As the index plate 46 indexes down, the center tab 62 (functional equivalent to the support flange) still maintains contact with the index plate 46 so that twenty pounds is maintained. In addition, a second center tab 66 has been added to add an additional twenty pounds of resistance. The fine adjustment is provided by the side tabs (56 and 68). As illustrated in FIG. 16 as an example, the right tab 68 is engaged with the index plate 46 so that five pounds of resistance is added to the two twenty pound center tabs (62 and 66) to make the total resistance forty-five pounds. The next notch would drop the right tab 68 and add the left tab 56. This adds ten pounds to the forty provided by the two center tabs to give a total of fifty-pounds of resistance. One more notch will add the right tab 68 with the left tab 56 and the two center tabs for a total of fifty-five pounds. The next step will drop the right tab 68 and the left tab 56 out and add a third center tab 70 to the center slot 64. Three twenty-pound resistance cords sums to sixty pounds of resistance to the user. This illustrates how this system can provide five pound increments to the user with a base of a plurality of twenty-pound resistance cords 13, one five-pound resistance cord 60 and one ten-pound resistance cord 58. This process would increase with each step for as many main resistance cords as desired.

A variation to this embodiment could include a single slot 64 without the left slot 50 and right slot 52. This single slot can include the larger resistance cords 13 as shown in the drawings or the center system of resistance cords 13 can alternate such that the higher resistance cord is followed by a lower resistance cord or any other combination and then a notched slot would preferably be used in that an alternate heavy and light cord can be picked up and dropped out of the resistance system as the index plate 46 is moved. In this way the increments can vary according to any design criteria desired. It is understood that any number of slots can be used in each embodiment and it is only a design variation. The general system will function in a like manner with greater or fewer increment settings.

Other variations are further illustrated in FIGS. 16 and 17. The index plate 46 can include a lip 72 as shown. This lip 72 or any other similar structure can be actuated directly by the user without the need of the knob 34. The system of the index plate 46 is similar as with the dial 34, only that the number of components of the system may be reduced by the possibility of actuating the index plate 46 directly by the user.

Figure 19:
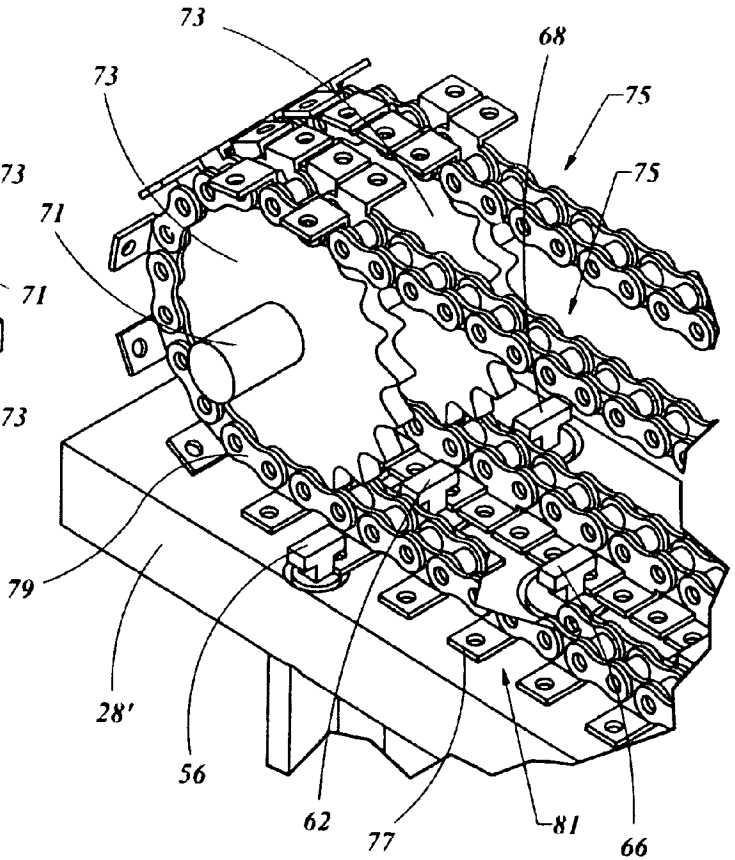
FIG. 19 is an isometric detail broken view of the resistance mechanism shown in FIG. 18 cut along the line 19-19 of FIG. 18.
Figure 18:
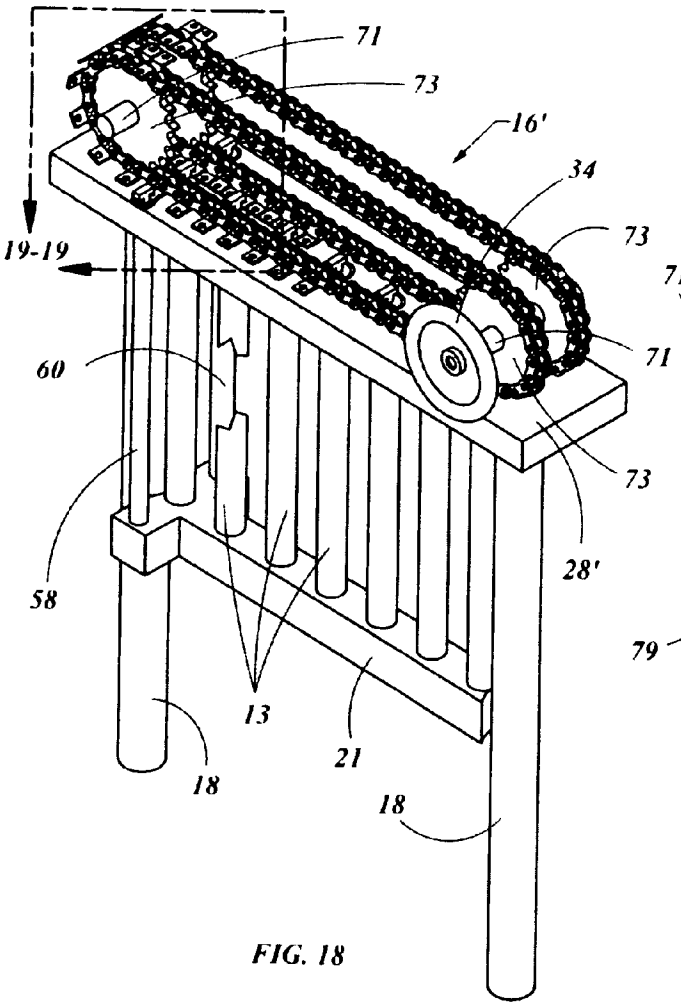
FIG. 18 is an isometric view of an alternative resistance mechanism with multiple pickup chains and parallel slide blocks.

As previously noted, it may be desirable to have a belt 26 and link 32 type system with more than one belting system running in parallel to actuate different combinations of resistance cords 13, thereby generating smaller increments in resistance. One example of such an indexing mechanism 16' is shown in FIGS. 18 and 19. In this view a vertical arrangement of the main cords 13 is attached to a carriage 21 as well as a low tension right cord 60 and a lower tension left cord 58. One of the center cords 13 is broken to better show the lower tension right cord 60. The modified support plate 28' acts as a support platform that is secured to the frame (not shown in this view) but is consistent in orientation and support of the rails 18. The indexing mechanism 16' is mounted to the top of the support plate 28' by way of two shafts 71. These shafts 71 would be journaled to the support plate 28' or the frame to allow rotational movement of the shafts 71 with their axes stationary with respect to the support plate 28'.

The shafts 71 are mounted to two sprockets 73 on each end of the support plate 28'. Each pair of sprockets 73 drive a custom conveyor chain 75. Each custom conveyor chain 75 has an arrangement of chain ears 77 that extend laterally from the base links 79 of the chain 75. The chain ears 77 are supported by the support plate 28' when on the lower run of the chain 75 loop. The chain ears 77 are positioned such that they provide selective interference with the left tab 56, center tab 62 and right tab 68 which are each secured to the upper ends of the resistance cords 58, 13 and 60 respectively. When a chain ear 77 is positioned between a tab (56, 62 or 68) and the support plate 28' that associated resistance band is secured to the support plate 28'. This indexing mechanism 16' is in this manner functionally equivalent to the sliding index plate 46 shown and described in FIGS. 14-17 only with a segmented rolling system provided by the chain 75 as opposed to a flat index plate 46 that slides in a linear manner. The spacing and orientation of the chain ears 77 are such that they can be made to alternatively pick up and drop off selected resistance cords so as to provide a variety of incremental resistances. A break out area 81 of the conveyor chain 75 is shown in FIG. 19 to better illustrate the second center tab 66 and as such, all other center tabs.

The indexing mechanism 16' as shown in FIGS. 18-19 is an embodiment that allows for similar adjustment capabilities as that shown and described in FIGS. 14-17, only here in a rotary rather than sliding system. It is understood that a single custom conveyor chain 75 could also be used to support one or two rows of resistance cords 13 as well as multiple chains 75 to pick any number of rows of resistance cords 13. The number of chains 75 and rows of cords 13 is not intended to be limited by the disclosure.

The dial 34 is shown here to be mounted to one of the shafts 71 and functions to drive the chain 75 relative to the support plate 28'. This dial 34 could also be mounted with a dedicated drive system that directly drives the conveyor chain 75. In some cases this would be desirable in that a single rotation of the dial 34 would be preferred to give a precise location of the conveyor chain 75 and therefore the specific combination of cords (58, 60 and 13) supported. In this case the dial 34 would be geared with a secondary drive sprocket (not shown) that drives the conveyor chain(s) 75 directly such that one revolution or less of the dial 34 moves the conveyor chain 75 through all possible combinations regarding support of the resistance cords (58, 60 and 13). In addition any one of a number of location systems known or disclosed herein can also be implemented to provide precise incremental advancement of the chain(s) 75 and therefore resistance combinations.

Figure 20:
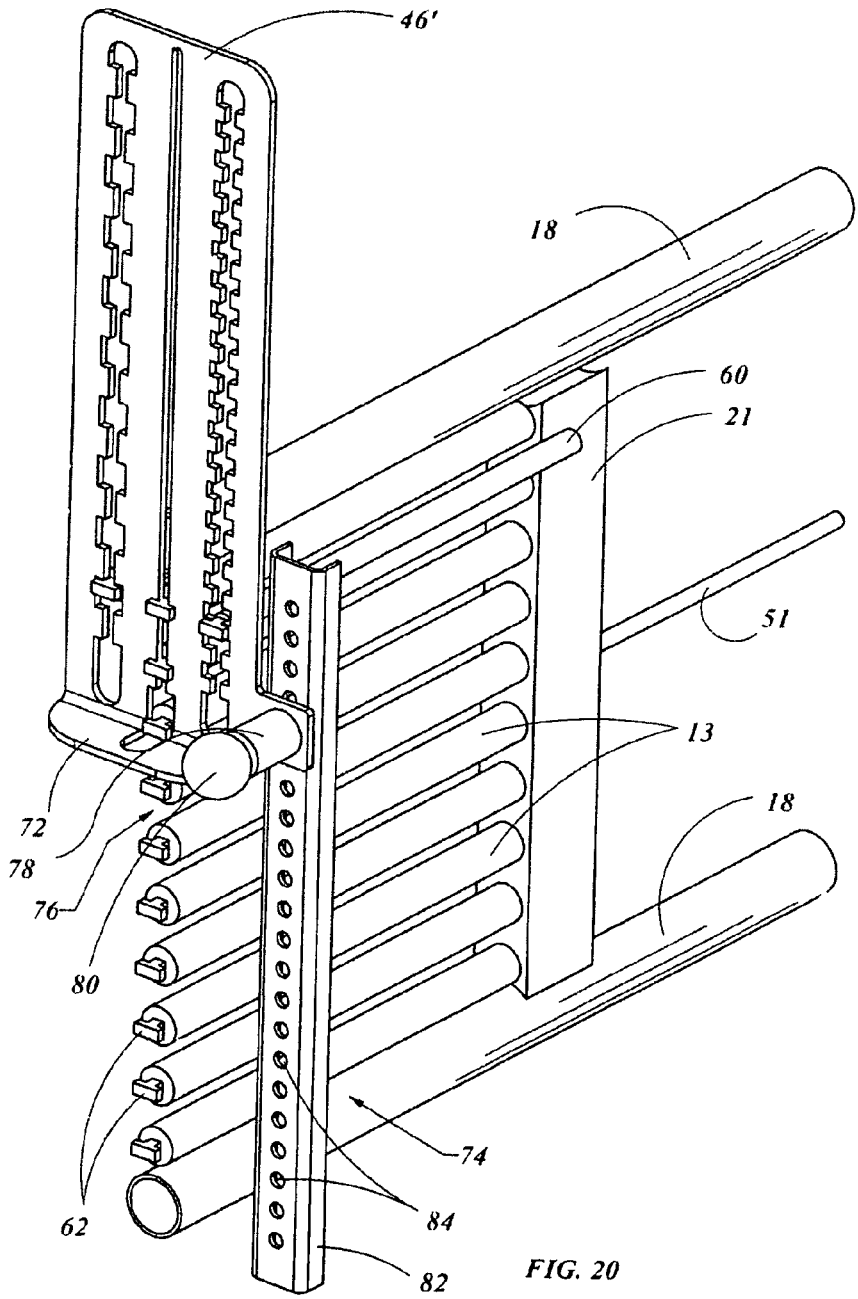
FIG. 20 is an isometric view of an alternative resistance system orientated similar to that of FIG. 16 with a pin and slide positioning system.

Another alternative to the system of index plate 46' location is shown in FIG. 20. In this embodiment the flexible member 48 and the dial 34 have been eliminated and the index plate 46' is actuated in a linear manner by engaging some structure on the index plate 46', such as the lip 72. A linear positioning system 74 is added to show another method of locating the index plate 46' relative to the cords 13 to ensure a specific load is provided in the cable 51 for the user. In this embodiment the index plate 46' includes a locking pin 76. There are many types of locking devices that could be adapted to work in this environment. A locking spring pin 76 as shown here has several advantages as will be discussed.

The locking pin 76 includes a cylinder 78 which houses a pin that includes a knob 80 mounted to one end. A compression spring is housed in the cylinder to bias the pin away from the knob 80 and toward the rail 82. The far end of the pin is received by one of a plurality of holes 84 in the rail 82. The cylinder 78 and knob 80 alone or together act as a handle, analogous to the lip 72 on the index plate 46' in that it can be grasped by the user to move the index plate 46' up or down. One advantage with such an assembly is the same hand can be used to grasp the knob 80, pull the knob 80 and attached pin away from the rail 82 and move it up or down to the desired location, all with one hand. The location and number of holes 84 in the rail 82 may be varied and are shown here as an illustrative example. In addition, in this embodiment the lip 72 could be removed from the index plate 46' if desired.

Figure 21:
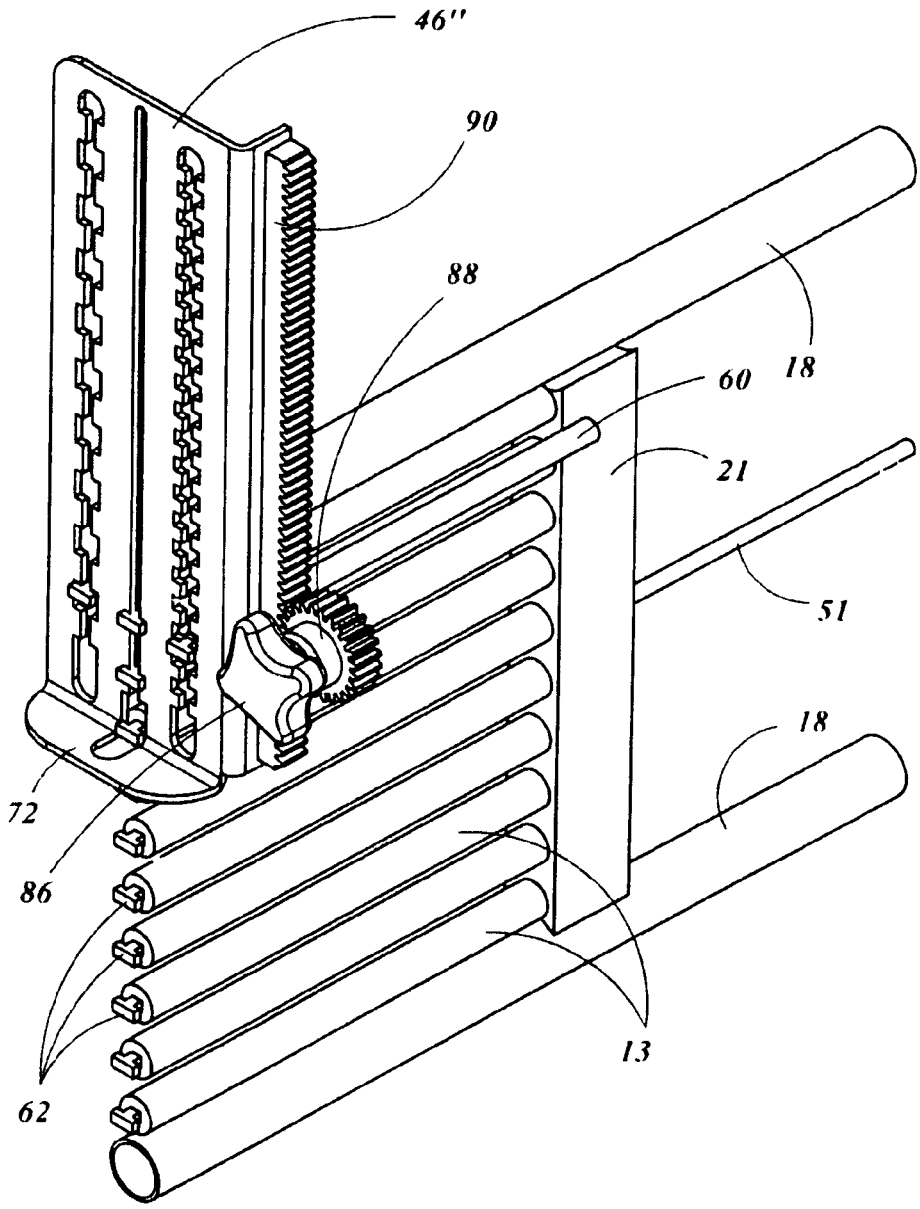
FIG. 21 is an isometric view of an alternative resistance system similar to that of FIG. 20 using a rack and pinion actuation system.

In a manner similar to that shown and described relating to FIG. 20, an embodiment including a rotating location system is shown in FIG. 21. In this embodiment the index plate 46" would, as with the other examples, also be moveably mounted in some guide or track to enable precise and consistent movement of the index plate 46" relative to the cords 13 & 60. A gear knob 86 is mounted to a pinion gear 88 which is in turn rotatably mounted to the frame 14 (not shown in this view). In doing so the axis of the pinion gear 88 is stationary with respect to the cords 13 and rails 18. A gear rack 90 is mounted to or otherwise continuous with the index plate 46". By actuating the gear knob 86 the pinion gear 88 drives the gear rack 90 and attached index plate 46" up or down to increase or decrease the engagement of the cords 13 with the index plate 46", thereby changing the resistance in the cable 51 to the user. This system provides a fine adjustment in the movement of the index plate 46" relative to the cords 13. One of any number of location mechanisms previously disclosed or otherwise known can be used in conjunction with this embodiment to ensure proper incremental movement of the index plate 46" and therefore engagement of the desired cords 13 & 60.

Figure 22:
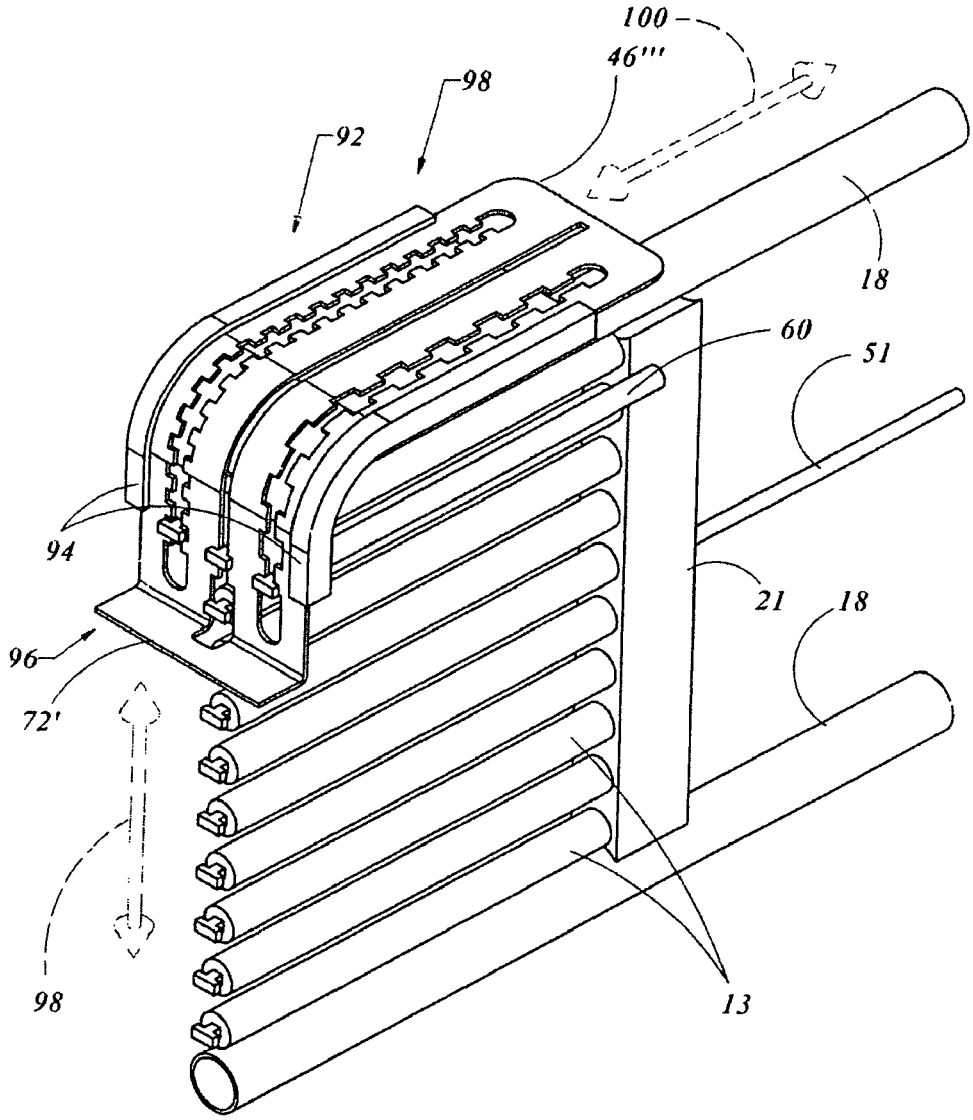
FIG. 22 is an isometric view of an alternative resistance system similar to that of FIG. 20 using a flexible index plate.

In another embodiment of the invention, a sliding index plate 46''' is illustrated in FIG. 22. An advantage to the embodiments disclosed herein is the forces applied by any of the cord tabs 62 as previously shown on any of the index plates 46 are primarily sheer forces. As such, only a small amount of material is needed to support a great deal of force. With materials including spring steel, a semi-pliable index plate 46''' can be made that will change orientation to follow a specific contour and yet structurally support the cord tabs 62 of the desired cords 13. An advantage is the overall package size can be reduced in that this index plate 46''' can adapt to the existing size and shape of the device 12. An example of this is shown here.

A plate guide 92 is positioned adjacent to the cords 13. The plate guide 92 may include a curved contour and a pair of plate guide rails 94 that receive the outside edges of the index plate 46'''. In this embodiment the lip 72' is positioned at a first end 96 of the index plate 46''' to give the user a handle to move the index plate 46''' up and down in accordance with the arrow 98. In this orientation of the index plate 46''' as the first end 96 moves up or down a second end 98 of the index plate 46''' moves back or forward as noted by the second arrow 100. This movement is directed by the plate guide 92, of which the shape and contour are infinitely variable to virtually any desired shape. The general function of the index plate 46''' is otherwise similar to that as previously disclosed.

Figure 23:
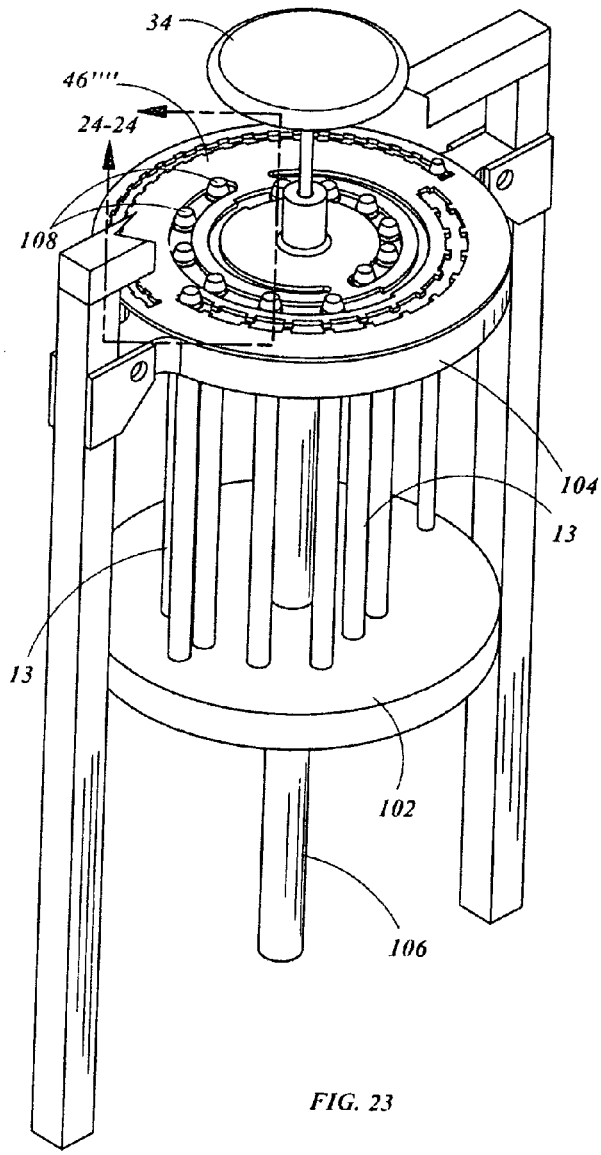
FIG. 23 is an isometric view of an alternative resistance system using a disk shaped index plate.
Figure 24:
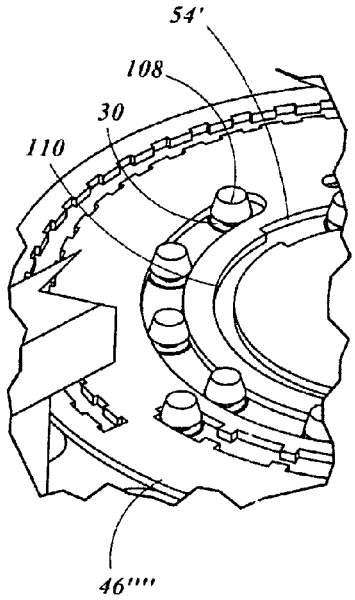
FIG. 24 is a detail view of a portion of the plate of FIG. 23 shown along line 24-24 in FIG. 23.

Another embodiment of the invention is to use a disc shaped index plate 46''''. This is illustrated in FIGS. 23 and 24. In this embodiment the cords 13 are positioned vertically and mounted to a lower plate 102. This lower plate is the functional equivalent to the carriage 21 in previous embodiments. The lower plate 102 is able to move down away from an upper plate 104 when actuated by a user by any attachment means desired. The lower plate 102 is shown here to be guided by a linear shaft 106 that would articulate with a bearing in the center of the lower plate 102. This is only one form of guiding the lower plate of which is infinitely variable and not intended to be limiting to the scope of the invention.

The cords 13 provide the resistance to downward movement of the lower plate 102. Support of the cords 13 to the upper plate 104 is determined by the orientation of the index plate 46'''' which is supported by the upper plate 104. Thereby the upper plate 104 is the functional equivalent to the support plate 28 of previous embodiments, providing support for the index plate 46''''. Though functionally equivalent to the process of selective engagement of the cords 13 to the index plate 46 in previous embodiments, this version allows the index plate 46'''' to be rotated rather than displaced in a linear manner. As with the other embodiments of the invention, one or more slots can be used with any embodiment shown. Also, any of the positioning systems shown or known can be incorporated into any of the embodiments.

The upper portion of the cords 13 include a cap cord 108 that has an undercut 30 suitable for engagement with arc slot 110 while allowing the cap 108 to pass through the opening 54'. The general function of this embodiment is otherwise similar to that as previously disclosed. The advantage is this arrangement may be desirable in some cases in necessitating a potentially smaller space requirement and thus potentially reducing shipping and storage costs.

In all embodiments of the invention disclosed thus far, the carriage 21 (and 102) is actuated away from the support plate 28 (and 104). The support plate 28 and index plate 46 are positioned stationary with respect to the frame 14 and the carriage 21 (and 102) is then movable with respect to the frame 12 with a second end of the resistance elements 13 secured to the carriage 21 (and 102). It is also possible to make the support plate 28 (and 104) part of the carriage 21 and be therefore movable with respect to the frame 14 while the second end of the resistance elements 13 are fixed to the frame 14. Preferably, the index plate 46 and support plate 28 (and 104) move relative to the second end (cord end not releasably secured to the index plate 46) of the resistance element 13. The specific movement relative to the frame 14 may be performed in either manner.

The foregoing detailed description of the present invention is provided for purposes of illustration and it is not intended to be exhaustive or to limit the invention to the particular embodiments shown. The embodiments may provide different capabilities and benefits, depending on the configuration used to implement features of the invention.

What is claimed is:

1. A resistance system for fitness equipment, comprising:

a frame;

a carriage moveably mounted to the frame;

plural resistance elements, each resistance element including an engagement element on a first end thereof and a second end coupled to the carriage;

an interference element comprising a substantially flat plate with at least one slot adapted to receive the engagement element; and a controller coupled to the interference element whereby actuation of the controller causes the interference element to selectively engage at least one resistance element thereby causing a corresponding resistance to movement of the carriage relative to the frame.

2. The resistance system described in claim 1, further comprising a support plate coupled to the frame and structurally supporting the interference element.

3. The resistance system described in claim 1, wherein the controller includes a dial with a position indicator.

4. The resistance system described in claim 1, wherein the controller includes a lip adapted to be grasped by a user.

5. The resistance system described in claim 1, further comprising a positioning system coupled to the interference element enabling incremental positioning of the interference element relative to the resistance elements.

6. The resistance system described in claim 5, wherein the positioning system includes a sprocket mounted to a dial and a spring biased pin engaging with detents in the sprocket.

7. The resistance system described in claim 5, wherein the positioning system includes a spring pin coupled to the interference element and releasably engaged with a rail secured to the frame.

8. The resistance system as described in claim 1, wherein the resistance element is selected from the group consisting of an elastic cord, a spring, a weight, a pneumatic cylinder and a hydraulic cylinder.

9. The resistance system as described in claim 1, wherein the engagement element includes an undercut adapted to receive the interference element.

10. The resistance system as described in claim 9, wherein the undercut is open on two ends thereby being able to receive and pass the interference element through the undercut.

11. The resistance system as described in claim 1, wherein the interference element is comprised of a link mounted to a pliable belt.

12. The resistance system as described in claim 1, wherein the interference element is comprised of a plurality of links mounted to a pliable belt.

13. The resistance system as described in claim 1, wherein the interference element is comprised of a plurality of links movably coupled one to another.

14. The resistance system as described in claim 13, further comprising a pliable belt connecting free ends of the plurality of links movably joined to form a continuous loop.

15. The resistance system as described in claim 1, wherein the slot is a notched slot providing more than one width of an area of the slot.

16. The resistance system as described in claim 1, wherein the substantially flat plate is a semi-pliable plate.

17. The resistance system as described in claim 1, wherein the interference element is comprised of a chain with at least one chain ear extending laterally from one side of a chain link.

18. The resistance system as described in claim 17, wherein the at least one chain ear is adapted to be received by the engagement element.

19. The resistance system as described in claim 1, wherein the resistance elements are comprised of resistance elements of substantially equal load producing capabilities.

20. The resistance system as described in claim 1, wherein the resistance elements are comprised of resistance elements that vary in load producing capability.

21. The resistance system as described in claim 1, wherein the interference element selectively engages a greater or lesser number of resistance elements, thereby causing a greater or lesser resistance to movement of the carriage relative to the frame.

22. The resistance system as described in claim 1, wherein the interference element selectively engages a desired number of the resistance elements thereby causing a desired level of resistance to movement of the carriage relative to the frame.

23. A resistance system for exercise equipment, comprising:

a frame;

a carriage moveably mounted to the frame;

plural resistance elements each resistance element including a first end coupled to a slide block and a second end coupled to the carriage;

an interference element comprising a substantially flat plate with at least one slot adapted to receive a portion of the slide block; and a controller mechanism coupled to the interference element whereby the controller mechanism selectively controls the coupling of the interference element with the slide blocks such that a first position of the controller mechanism causes a first resistance to movement of the carriage and a second position of the controller mechanism causes a second resistance to movement of the carriage and the first resistance is not equal to the second resistance.

24. The resistance system described in claim 23, further comprising a support plate coupled to the frame and supporting the interference element.

25. The resistance system described in claim 23, wherein the controller mechanism includes a dial with a position indicator.

26. The resistance system described in claim 23, wherein the controller mechanism includes a lip adapted to be grasped by a user.

27. The resistance system described in claim 23, further comprising a positioning system coupled to the interference element for positioning of the interference element relative to the resistance elements.

28. The resistance system described in claim 27, wherein the positioning system includes a sprocket mounted to a dial and a spring biased pin engaging with detents in the sprocket.

29. The resistance system described in claim 27, wherein the positioning system includes a spring pin coupled to the interference element and releasably engaged with a rail secured to the frame.

30. The resistance system as described in claim 23, wherein the resistance element is selected from the group consisting of an elastic cord, a spring, a weight, a pneumatic cylinder and a hydraulic cylinder.

31. The resistance system as described in claim 23, wherein the slide block includes an engagement element with an undercut adapted to receive the interference element.

32. The resistance system as described in claim 31, wherein the undercut is open on two ends thereby being able to receive and pass the interference element through the undercut.

33. The resistance system as described in claim 23, wherein the interference element is comprised of a link mounted to a pliable belt.

34. The resistance system as described in claim 23, wherein the interference element is comprised of a plurality of links mounted to a pliable belt.

35. The resistance system as described in claim 23, wherein the interference element is comprised of a plurality of links movably coupled one to another.

36. The resistance system as described in claim 35, further comprising a pliable belt connecting free ends of the plurality of links movably joined to form a continuous loop.

37. The resistance system as described in claim 23, wherein the slot is a notched slot providing more than one width of an area of the slot.

38. The resistance system as described in claim 23, wherein the substantially flat plate is a semi-pliable plate.

39. The resistance system as described in claim 23, wherein the interference element is comprised of a chain with at least one chain ear extending laterally from one side of a chain link.

40. The resistance system as described in claim 39, wherein the at least one chain ear is adapted to be received by the slide block.

41. The resistance system as described in claim 23, wherein the resistance elements are comprised of resistance elements of substantially equal load producing capabilities.

42. The resistance system as described in claim 23, wherein the resistance elements are comprised of resistance elements that vary in load producing capability.

43. A resistance system for fitness equipment, comprising:

a frame;

a carriage moveably mounted to the frame;

a resistance mechanism including a support flange;

an interference mechanism comprising a substantially flat plate with at least one slot adapted to receive the support flange of the resistance mechanism; and a controller coupled to the interference mechanism whereby actuation of the controller enables selective engagement of the resistance mechanism to the interference mechanism.

44. The resistance system described in claim 43, further comprising a positioning system coupled to the interference means enabling incremental positioning of the interference means relative to the resistance element.

45. The resistance system described in claim 43, further comprising a support plate coupled to the frame and enabling structural support of the interference means.

46. A resistance system for exercise, comprising:

a frame;

a carriage moveably mounted to the frame;

plural resistance elements each including an engagement element on a first end and a second end coupled to the frame;

an interference element comprising a substantially flat plate with at least one slot adapted to receive the engagement element of the resistance elements, the interference element being coupled to the carriage; and a controller coupled to the interference element, whereby actuation of the controller enables selective engagement of the resistance elements with the interference element.

47. A method of operating an exercise device including a frame; a carriage moveably mounted to the frame; plural resistance elements each including an engagement element on a first end and a second end coupled to the carriage; including the steps of:

establishing an interference element including a substantially flat plate with at least one slot to receive the engagement element of at least one of the resistance elements;

actuating a controller operatively coupled to the interference element to position the interference element relative to the resistance elements to engage at least one of the engagement elements by the interference element; and displacing the carriage to actuate the resistance element, thereby exercising the muscles of a user.

* * * * *